US005088266A

United States Patent [19]

Wassenhoven

[11] Patent Number: 5,088,266

[45] Date of Patent: Feb. 18, 1992

[54] SLIVER FEEDING AND OPENING DEVICE OF AN OPEN-END SPINNING MACHINE

[75] Inventor: Heinz-Georg Wassenhoven, Monchengladbach, Fed. Rep. of Germany

[73] Assignee: W. Schlafhorst & Co., Moenchengladbach, Fed. Rep. of Germany

[21] Appl. No.: 324,581

[22] Filed: Mar. 16, 1989

[30] Foreign Application Priority Data

Mar. 23, 1988 [DE] Fed. Rep. of Germany ..... 3809717

[51] Int. Cl.[5] ..... D01H 4/36

[52] U.S. Cl. ..... 57/408

[58] Field of Search ..... 57/400, 404, 408, 409, 57/410, 411, 412; 19/99, 112, 114

[56] References Cited

U.S. PATENT DOCUMENTS

| | | | |
|---|---|---|---|
| 4,321,788 | 3/1982 | Alston | 57/408 |
| 4,459,801 | 7/1984 | Stahlecker et al. | 57/412 |
| 4,471,607 | 9/1984 | Schmolke | 57/408 |
| 4,607,485 | 8/1986 | Stahlecker | 57/408 |

FOREIGN PATENT DOCUMENTS

| | | |
|---|---|---|
| 2606193 | 9/1976 | Fed. Rep. of Germany . |
| 2932562 | 2/1981 | Fed. Rep. of Germany . |

*Primary Examiner*—Joseph J. Hail, III

*Attorney, Agent, or Firm*—Shefte, Pinckney & Sawyer

[57] ABSTRACT

To improve the quality of spun yarn, a fiber aligning apparatus is formed in the interior wall of the housing of a sliver feeding and opening device of an open-end spinning machine. The fiber aligning apparatus includes as plurality of aligning elements, which are integrally formed from the wall of the housing, for aligning the individual sliver fibers during their travel within the housing. The aligning elements are formed in a recess in the wall of the housing which extends concavely in the circumferential direction of the cylindrical housing wall. Each aligning element is in the form of an angled tooth projecting inwardly with respect to the housing and terminating in an apex, the tooth apices defining an arcuate extent of the cylindrical surface of the housing concentric with the opening roller of the sliver feeding and opening device.

5 Claims, 3 Drawing Sheets

SLIVER FEEDING AND OPENING DEVICE OF AN OPEN-END SPINNING MACHINE

BACKGROUND OF THE INVENTION

The present invention relates to a sliver feeding and opening device of an open-end spinning machine and, more particularly, to means for aligning the sliver fibers in generally parallel alignment with one another as the fibers exit the sliver feeding and opening device.

Spun yarn produced by open-end spinning machines can be improved if the fibers of the sliver fed from the sliver feeding and opening device have been aligned in parallel alignment with one another to a relatively high degree before these fibers travel along the guide conduit of the sliver feeding and opening device into the spinning chamber of the associated open-end spinning machine. To effect this desired parallel alignment, it is known to mount saw-type teeth or pins on the outer circumference of the opening roller and on the inner surface of the housing of the sliver feeding and opening device facing the opening roller in the region of the housing between the guide plate associated with the intake opening of the sliver feeding and opening device and the guide conduit leading to the spinning chamber of the open-end spinning machine.

In German Patentschrift 29 32 562, a sliver feeding and opening device for an open-end spinning machine is disclosed in which the so-called paralleling members are mounted in the wall of the housing before the opening for the discharge of dirt and other debris of the sliver (with respect to the direction of rotation of the opening roller) and before the opening of the guide conduit leading to the spinning chamber of the open-end spinning machine. These so-called paralleling members are provided as an exchangeable, integral unit adapted to be releasably disposed in corresponding recesses in the housing of the sliver feeding and opening device. However, these paralleling members can create undesirable operating conditions in the sliver feeding and opening device in that these members, in conjunction with the housing, form transition locations or discontinuities on which hook the opened fibers and thereby cause accumulations of such fibers at these locations which can lead to disruption of the spinning operation if the fiber accumulations come loose and travel into the spinning apparatus.

In German Offenlegungsschrift 26 06 193, paralleling members are disclosed which are formed in the shape of flattened teeth. The flattened portion of each tooth is arranged opposite the opening roller of the sliver feeding and opening device.

SUMMARY OF THE INVENTION

The present invention provides means for aligning the sliver fibers and a sliver feeding and opening device of an open-end spinning machine in generally parallel alignment with one another which does not form undesirable transition locations or discontinuities on which open fibers can accumulate. Further, the present invention includes means for aligning sliver fibers in the form of angled teeth.

Briefly described, the present invention is incorporated in a sliver feeding and opening device of an open-end spinning machine of the type having a housing with an interior wall defining a cylindrical surface, a toothed opening roller rotatably disposed in the housing coaxial with the cylindrical surface, an intake opening for intake of sliver into the housing, a guide plate associated with the intake opening and a discharge conduit for the discharge of sliver fibers from the housing. The invention provides means for aligning the sliver fibers in generally parallel alignment with one another. The alignment means is disposed between the intake opening and the discharge conduit and is integrally formed in the interior wall of the housing. The alignment means includes a plurality of angled teeth arranged in rows, the teeth projecting inwardly with respect to the housing and terminating in apices and the apices defining an arcuate extent of the cylindrical surface concentric with the toothed opening roller.

The interior wall of the housing includes a recess in which the angled teeth are formed. In one embodiment, the recess is in the form of an arcuate segment of a cylinder having a radius less than the radius of the cylindrical surface of the housing, the recess extending concavely in the circumferential direction of the cylindrical surface of the housing. In another embodiment, the recess extends concavely in the circumferential direction of the cylindrical surface of the housing and extends concavely transversely to the circumferential direction of the cylindrical surface of the housing, thereby defining a segment of a spheroidal surface. According to one aspect of the present invention, the extent of the recess extending concavely in the circumferential direction of the cylindrical surface of the housing and the extent of the recess extending concavely transversely to the circumferential direction of the cylindrical direction of the housing define a sphere. According to one aspect of the present invention, the arcuate ends of the recess lie on a chord of the cylindrical surface of the housing and the center of the recess lies on a radius of the opening roller which intersects the chord. According to another aspect of the present invention, the center of the extent of the recess extending concavely transversely to the circumferential direction of the cylindrical surface of the housing lies on a line extending between the axis of the opening roller and the middle transversely of the circumference of the opening roller.

DETAILED DESCRIPTION OF THE PREFERRED EMBODIMENTS

Figure 1:
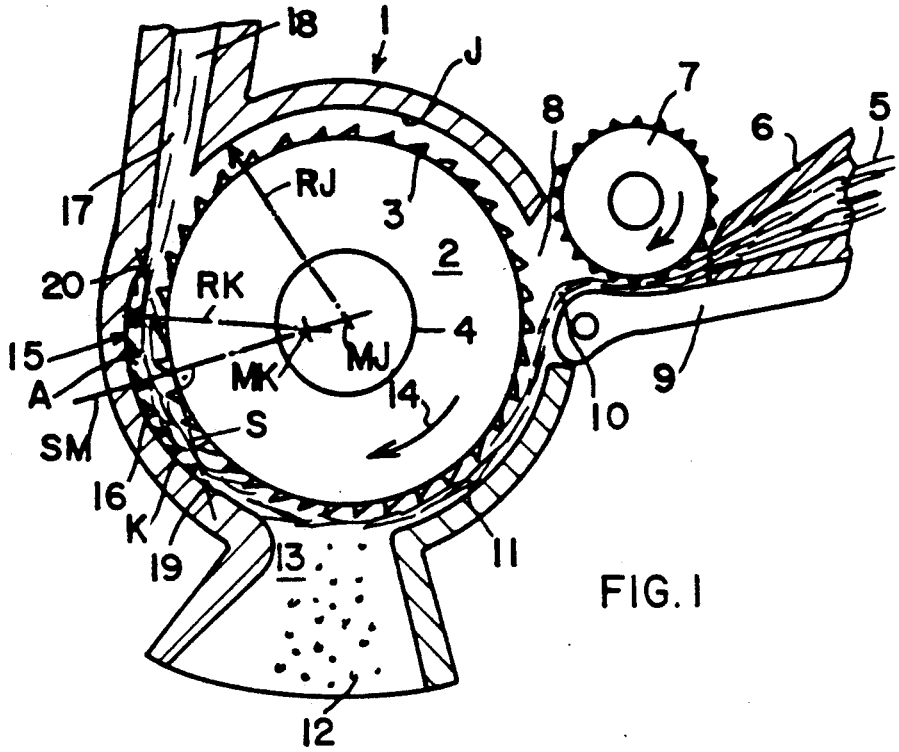
FIG. 1 is a vertical sectional view of one embodiment of the fiber alignment means of the present invention, shown in a sliver feeding and opening device of an open-end spinning machine.

In FIG. 1, one embodiment of the fiber aligning means of the present invention is illustrated. A housing 1 of a sliver feeding and opening device of an open-end spinning machine has an opening roller 2 rotatably mounted therein for rotation on a shaft 4. The opening roller 2 has a fiber combing component 3 thereon for effecting opening and separating of sliver fibers and the fiber combing component 3 includes a plurality of teeth secured around the outer circumference of the opening roller 2.

A sliver 5 to be opened by the sliver feeding and opening device is fed to the opening roller 2 through an intake opening 8 in the housing 1 via a compressor member 6 by a sliver feed roller 7 rotatably mounted adjacent the opening roller 2 at the intake opening 8. A guide plate 9 is pivotally connected to the housing 1 adjacent the intake opening 8 and is biased by a spring (not shown) toward the sliver feed roller 7, whereby the guide plate 9 automatically adjusts to the changing forces exerted by the sliver passing between the guide plate 9 and the sliver feed roller 7.

By means of the fiber combing component 3 thereon, the opening roller 2 combs the incoming sliver 10 to separate individual fibers 11 therefrom. The combed-out fibers 11 are entrained in an air current traveling within the housing 1 and travel therewith. The air current can, for example, be the by-product of the negative pressure created by the spinning rotor of the open-end spinning machine. While the relatively lightweight combed-out individual fibers 11 remain entrained with the air current, dirt and other debris 12 exit the housing 1 under the action of centrifugal forces through a debris opening 13. The debris 12 travels to an apparatus (not shown) for collection and/or removal.

Continuing further in the rotation direction indicated by the arrow 14 of the opening roller 2, the interior wall of the housing 1 is provided with a fiber aligning means 15 which includes a plurality of aligning elements 16, such as angled teeth. The fiber aligning means 15 extends along the interior wall of the housing 1 in the region between the debris opening 13 and the exit opening 17 of a guide conduit 18 through which the individual fibers 11 are guided to the spinning machine.

The fiber aligning means 15 is integrally formed with the interior wall of the housing 1 and is disposed in a recess A in the interior wall of the housing. The interior wall of the housing defines a cylindrical surface I. The recess A is in the form of an arcuate segment of the cylindrical surface I of the housing and has a radius less than the radius of the cylindrical surface I. Specifically, the recess A is in the shape of an arcuate concave contour K extending concavely in the circumferential direction of the cylindrical surface I of the interior wall of the housing. Accordingly, the interior wall of the housing 1 extends radially outwardly from the outer circumferential surface of the opening roller 2 in forming the recess A.

The aligning elements 16 are formed in the recess A and these elements are similar to the mounting saw-tooth type teeth of the fiber combing component 3 of the opening roller 2. Alternatively, the aligning elements 16 can be pin-like in shape. The apices 16' of the aligning elements 16 (or pins) define an arcuate extent of the cylindrical surface I of the housing concentric with the opening roller 2 and the apices are aligned with the inner contour I of the housing 1. The spacing between the fiber combing component 3 on the opening roller 2 and the arcuate extent defined by the apices 16' is approximately equal to the spacing between the fiber combing component 3 and the cylindrical surface I of the interior wall of the housing 1.

The aligning elements 16 can be formed directly from the material comprising the interior wall of the housing 1 by, for example, grinding, milling, or other suitable forming methods. Alternatively, the aligning elements 16 can be mounted in the interior wall, which is particularly suitable if the aligning elements 16 are needles or pins. The aligning elements 16 are arranged in parallel rows. In the preferred embodiment, each paralleling element 16 is in the shape of a saw-tooth and is oriented such that its saw-tooth shape is 180° opposite to the orientation of the saw-teeth of the fiber combing components 3 of the opening roller 2 with respect to the rotation direction 14.

The integral formation of the aligning elements 16 from the interior wall of the housing 1 offers several advantages including, for example, the advantage that no portion of the interior wall of the housing 1 is separately inserted, in contrast to those sliver feeding and opening devices having inserted members, which can create gaps and transition points or discontinuities at which the combed-out fibers disadvantageously snag and accumulate.

To insure that the fiber aligning means 15 of the present invention does not create any corners, shoulders or other discontinuities with the interior wall of the housing 1 on which the combed-out fibers can snag, the recess A is shaped with an arcuate contour K. The radial center MK of the arcuate contour K lies on a segment SM which is perpendicular to a chord S of the cylindrical surface I of the housing 1. The chord S extends to intersect the two transition points 19, 20 between the contour K and the cylindrical surface I of the housing 1. The segment SM extends through the radial center of the contour I of the housing 1. The radius RI of the cylindrical surface I is greater than the radius RK of the arcuate contour K. Through variation of the radius RK of the arcuate contour K, the depth of the recess A and, correspondingly, the size and/or the height of the aligning elements 16 can be determined. The size of the recess A as well as the height of the aligning elements 16 can thus be selected to accommodate the character of the sliver material to be opened and aligned.

In operation, the combed-out and separated fibers 11, from which the debris 12 has been substantially removed, is transported by means of the air stream within the housing 1 to the region of the fiber aligning means 15 of the present invention whereat the aligning elements 16 align the individual fibers generally parallel to one another. Fibers treated in such a manner enhance the quality of the spun yarn which they form especially if the fibers are non-linear and exhibit hooking tendencies.

Figure 2:
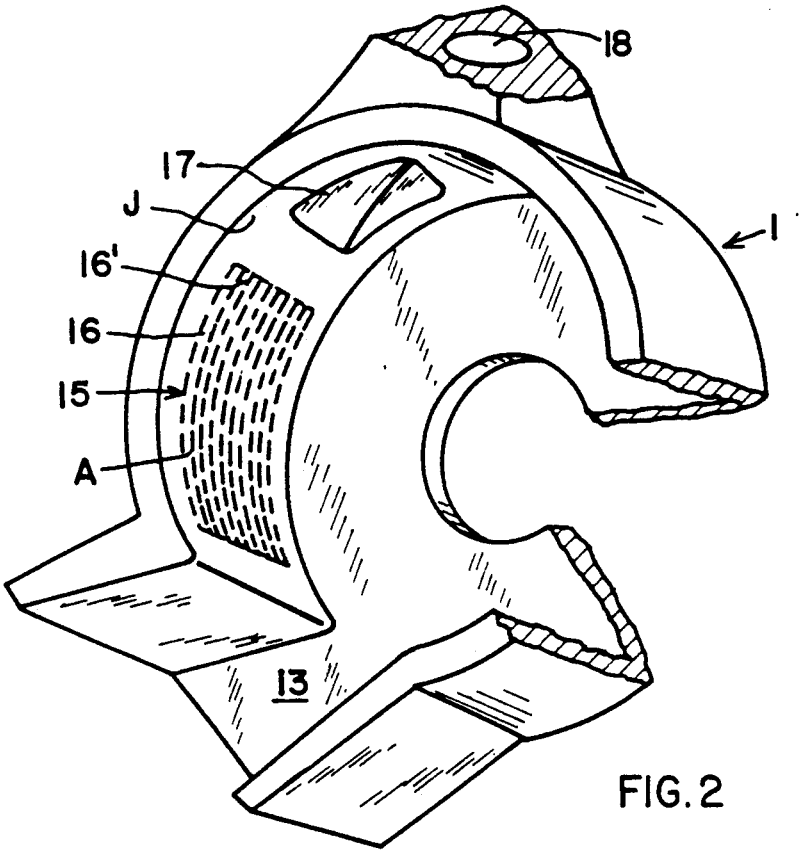
FIG. 2 is a perspective view, partially broken away, of the housing of a sliver feeding and opening device of an open-end spinning machine, showing one embodiment of the fiber aligning means of the present invention.

In FIG. 2, the position of the fiber aligning means 15 illustrated in FIG. 1 in the interior wall of the housing 1 is illustrated. The fiber aligning means 15 extends between the debris opening 13 and the exit opening 17, with the aligning elements 16 arranged in parallel rows with their apices 16' cylindrically aligned with the cylindrical surface I of the housing 1.

Figures 3, 3A:
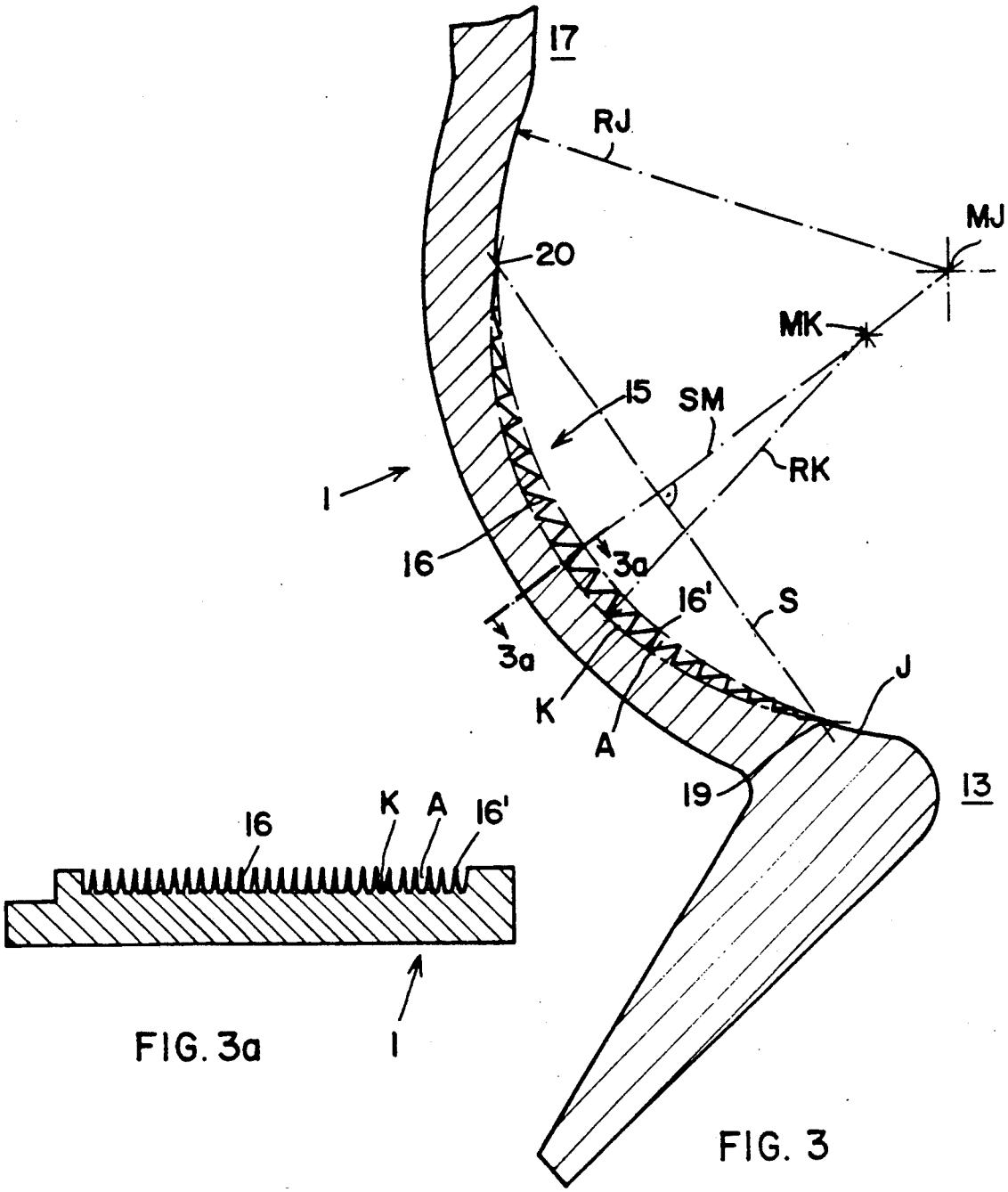
FIG. 3 is an enlarged vertical sectional view of the fiber aligning means shown in FIG. 2.
FIG. 3*a* is a sectional view of the fiber aligning means shown in FIG. 3, taken along lines III—III.

In FIG. 3, the fiber aligning means 15 of the present invention illustrated in FIG. 1 is shown in an enlarged view. The recess A in the interior wall of the housing 1 defines an arcuate contour K. The aligning elements 16 are arranged in the recess A and are formed in the shape of saw-teeth which, as viewed in the direction of the travel of the fibers 11, exhibit a triangular shape in which the intersection of two sides of the triangle form the apex of the tooth with the side of the triangle facing the direction of travel of the fibers 11 being shorter than the trailing side of the triangle. In this manner, the inclination of the teeth of the aligning elements 16 is opposite to the inclination of the teeth of the fiber combing component 3 of the opening roller 2, thereby considerably increasing the parallel alignment effect of the paralleling elements 16.

The aligning elements 16 of the fiber aligning means 15 gradually increase in size along the extent of the fiber aligning means 15 extending from a transition point 19 adjacent the debris opening 13 which represents one intersection of the recess A with the interior wall of the housing 1, which is one end of the segment SM, to the midpoint of the recess in the region of the segment SM. Along the extent of the fiber aligning means 15 from the segment SM toward a transition point 20 adjacent the exit opening 17, which represents the other intersection of the recess A with the interior wall of the housing, the size of the aligning elements 16 gradually decreases. After the fibers 11 pass by the transition point 20, the fibers exit through the exit opening 17 into the guide conduit 18.

Figure 4:
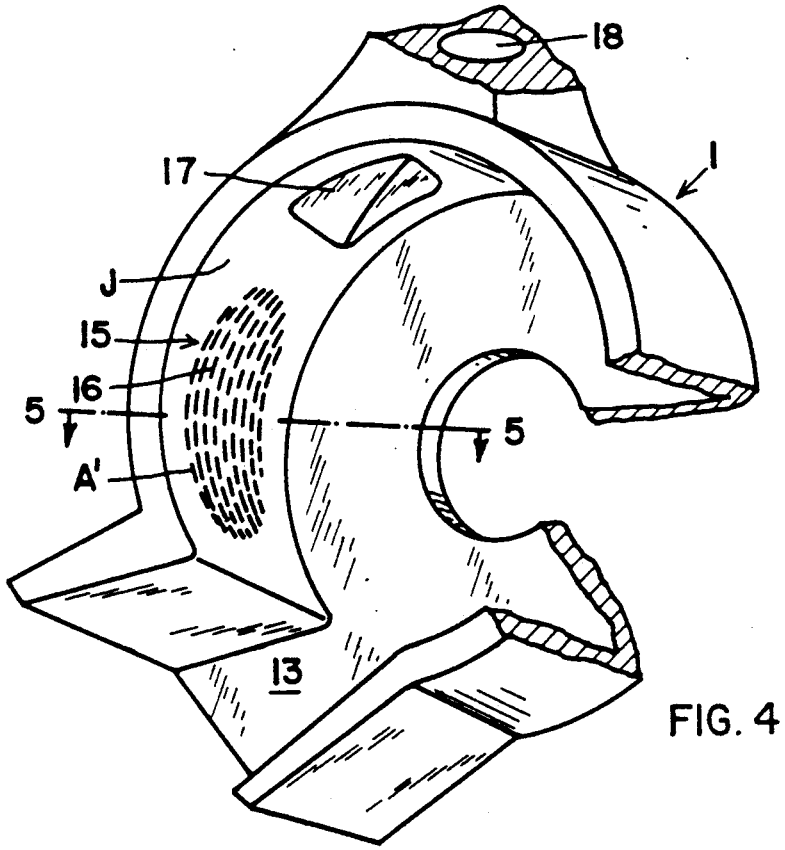
FIG. 4 is a perspective view, partially broken away, of a housing of a sliver feeding and opening device of an open-end spinning machine, showing another embodiment of the fiber aligning means of the present invention.

In FIG. 4, another embodiment of the fiber aligning means 15 of the present invention is illustrated. This fiber aligning means 15 also is located between the debris opening 13 and the exit opening 17 and includes a recess A' formed in the interior wall of the housing 1 in a barrel-shape having a contour K'. The recess A' extends concavely in the circumferential direction of the cylindrical surface I of the housing 1 and extends concavely transversely to the circumferential direction of the cylindrical surface of the housing, thereby defining a segment of a spheroidal surface. Additionally, the extent of the recess A' extending concavely in the circumferential direction of the cylindrical surface I of the housing 1 and the extent of the recess A' extending concavely transversely to the circumferential direction of the cylindrical surface I of the housing 1 define a sphere. The radial midpoint MK' of the contour K' lies on a line segment SM', which is perpendicularly oriented to a maximum chord S' of the cylindrical surface I of the interior wall of the housing 1, passes through the axis MI of the opening roller 2 and extends between the axis MI and the middle transversely of the circumference of the opening roller 2.

In the embodiment of FIG. 4, the recess A' is increasingly wider and deeper as the fiber alignment means 15 extends from adjacent the debris opening 13 to the maximum chord S, at which the recess A' reaches its greatest width and depth. Thereafter, the width and depth of the recess A' gradually decreases until it is flush with the interior wall of the housing 1 at the portion of the fiber aligning means 15 adjacent the exit opening 17. The aligning elements 16 vary in height in correspondence with the depth of the recess A' so that the apices 16' of the aligning elements 16 are in cylindrical alignment with the cylindrical surface I of the housing 1. Thus, the height of the aligning elements 16 continuously decreases toward the periphery of the fiber aligning means 15 in opposite directions from the center region thereof along both a concave line extending transversely to the circumferential direction of the cylindrical surface I as well as along a concave line extending circumferentially with respect to the cylindrical surface I.

Figure 5:
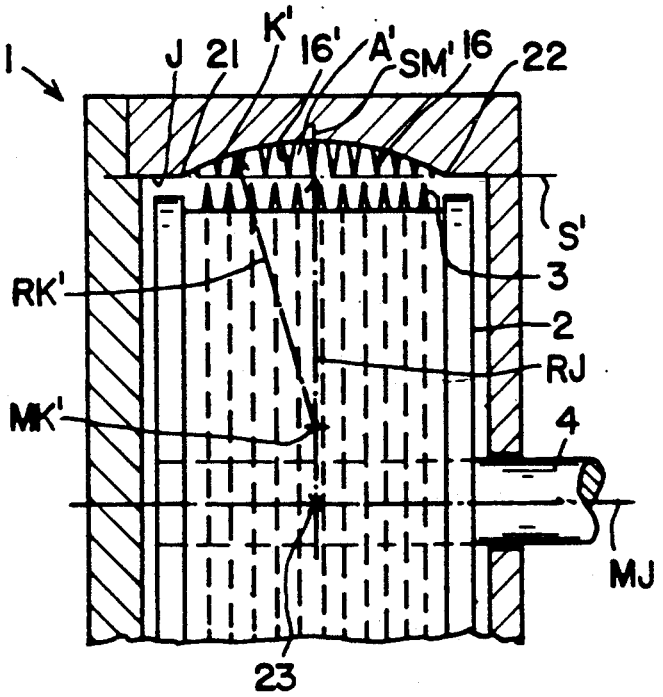
FIG. 5 is a partial cross-sectional view of the fiber aligning means shown in FIG. 4, taken along lines V—V.

In FIG. 5, the fiber aligning means 15 shown in FIG. 4 is illustrated in cross-section. The recess A' forms a segment of a sphere in the interior wall of the housing 1. The recess is bounded by the cylindrical surface I of the interior wall and intersects the cylindrical surface I at transverse mid-transition points 21 and 22. The chord S' lies on the transition points 21, 22, which represents the intersection of the recess A' with the interior housing wall along an arcuate contour K'. The radial center MK' of the contour K' lies on the segment SM' which is perpendicular to the chord S'. The segment SM' passes through the axis line MI of the shaft 4 of the opening roller 2 and intersects this axis MI at a symmetry point 23 of the opening roller 2.

As viewed from the symmetry point 23, the segment SM' also includes the radius RI of the contour I of the housing 1. The radius RI is greater than the radius RK' of the contour K' of the recess A'.

The fiber-combing component 3 of the opening roller 2 is disposed opposite the aligning elements 16. The aligning elements 16 are of their largest size in the region of the recess A' which is opposite the middle transversely of the circumferential surface of the opening roller 2. The greatest concentration of the fibers 11 is typically found in this region of the recess A' and, accordingly, the desired parallel aligning effect is at its strongest thereat.

To optimally form the contour of the recess A', the interior wall of the housing 1 can be pressed with a member symmetrical about an axis of rotation, whose axis is positioned parallel to the axis of the opening roller 2 and whose symmetry line is coincidental with the symmetry line of the opening roller 2. No sharp transitions between the contour of the interior wall of the housing 1 and the contour of the recess A' occur through this manufacturing process. In the region of the relatively greatest concentration of the fibers 11—that is, the region corresponding to the middle transversely of the circumferential surface of the opening roller 2, the fiber aligning means 15 has its greatest depth in the circumferential direction of the cylindrical contour of the housing 1. Suitable shapes for rotating tools for forming the fiber aligning means 15 include, for example, barrels, ellipsoids, paraboloids or hyperboloids, and the forming of the aligning elements by the tools may be by grinding or milling or other suitable method.

If the aligning elements are formed from needles or pins, the pins are arranged with their axes in parallel rows concentric with the middle line of the cylindrical surface I of the housing 1.

The present invention also contemplates positioning a fiber aligning means between the intake opening 8 and the debris opening 13. Additionally, the present invention contemplates coating the aligning elements with protective coating such as, for example, diamond coatings, to protect the aligning elements from abrasion and wear and to increase the frictional character of the aligning elements.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A sliver feeding and opening device for an open-end spinning machine, comprising:

a housing with an interior wall, the interior wall including a pair of continuous arcuate portions defining a cylindrical surface of the housing and the interior wall including a recess in the form of an arcuate segment of a cylinder having a radius less than the radius of the cylindrical circle of the housing and extending concavely in the circumferential direction of the cylindrical surface of the housing;

a toothed opening roller rotatably disposed in the housing co-axial with the cylindrical surface of the housing;

an intake opening for intake of sliver into the housing;

a guide plate associated with the intake opening;

a discharge conduit for the discharge of sliver fibers from the housing, the continuous arcuate portions of the interior wall being disposed between the intake opening and the discharge opening in the direction of rotation of the toothed opening roller and extending axially inwardly from a respective circumferential edge of the interior wall, the continuous arcuate portions being spaced from one another relative to the axis of the toothed opening roller and defining therebetween an intermediate portion, the intermediate portion having a continuous surface co-extensive with the continuous arcuate portions of the interior wall; and means for aligning the sliver fibers in generally parallel alignment with one another, the aligning means being disposed on the intermediate portion between the intake opening and the discharge conduit and being integrally formed with the intermediate portion of the interior wall of the housing, the aligning means including a plurality of angled teeth arranged in rows, the angled teeth being formed in the recess of the interior wall of the housing, the teeth projecting inwardly with respect to the housing and terminating in apices, the apices defining an arcuate extent of the cylindrical surface concentric with the toothed opening roller.

2. A sliver feeding and opening device according to claim 1 wherein the arcuate ends of the recess are on a chord of the cylindrical surface of the housing and the center of the arc defining the recess lies on the radius of the opening roller which intersects the chord.

3. A sliver feeding and opening device for an open-end spinning machine, comprising:

a housing with an interior wall, the interior wall including a pair of continuous arcuate portions defining a cylindrical surface of the housing and the interior wall including a recess extending concavely in the circumferential direction of the cylindrical surface of the housing and concavely transversely to the circumferential direction of the cylindrical surface of the housing, thereby defining a segment of a spheroidal surface;

a toothed opening roller rotatably disposed in the housing co-axial with the cylindrical surface of the housing;

an intake opening for intake of sliver into the housing;

a guide plate associated with the intake opening;

a discharge conduit for the discharge of sliver fibers from the housing, the continuous arcuate portions of the interior wall being disposed between the intake opening and the discharge opening in the direction of rotation of the toothed opening roller and extending axially inwardly from a respective circumferential edge of the interior wall, the continuous arcuate portions being spaced from one another relative to the axis of the toothed opening roller and defining therebetween an intermediate portion, the intermediate portion having a continuous surface co-extensive with the continuous arcuate portions of the interior wall; and means for aligning the sliver fibers in generally parallel alignment with one another, the aligning means being disposed on the intermediate portion between the intake opening and the discharge conduit and being integrally formed with the intermediate portion of the interior wall of the housing, the aligning means including a plurality of angled teeth arranged in rows, the angled teeth being formed in the recess of the interior wall of the housing, the teeth projecting inwardly with respect to the housing and terminating in apices, the apices defining an arcuate extent of the cylindrical surface concentric with the toothed opening roller.

4. A sliver feeding and opening device for an open-end spinning machine, comprising:

a housing with an interior wall, the interior wall including a pair of continuous arcuate portions defining a cylindrical surface of the housing and the interior wall including a recess extending concavely in the circumferential direction of the cylindrical surface of the housing and extending concavely transversely to the circumferential direction of the cylindrical surface of the housing to define a sphere;

a toothed opening roller rotatably disposed in the housing co-axial with the cylindrical surface of the housing;

an intake opening for intake of sliver into the housing;

a guide plate associated with the intake opening;

a discharge conduit for the discharge of sliver fibers from the housing, the continuous arcuate portions of the interior wall being disposed between the intake opening and the discharge opening in the direction of rotation of the toothed opening roller and extending axially inwardly from a respective circumferential edge of the interior wall, the continuous arcuate portions being spaced from one another relative to the axis of the toothed opening roller and defining therebetween an intermediate portion, the intermediate portion having a continuous surface co-extensive with the continuous arcuate portions of the interior wall; and means for aligning the sliver fibers in generally parallel alignment with one another, the aligning means being disposed on the intermediate portion between the intake opening and the discharge conduit and being integrally formed with the intermediate portion of the interior wall of the housing, the aligning means including a plurality of angled teeth arranged in rows, the angled teeth being formed in the recess of the interior wall of the housing, the teeth projecting inwardly with respect to the housing and terminating in apices, the apices defining an arcuate extent of the cylindrical surface concentric with the toothed opening roller.

5. A sliver feeding and opening device according to claim 4 wherein the center of the extent of the recess extending concavely transversely to the circumferential direction of the cylindrical surface of the housing lies on a line extending between the axis of the opening roller and the middle transversely of the circumference of the opening roller.

* * * * *